US010578320B2

(12) United States Patent
Sawada

(10) Patent No.: US 10,578,320 B2
(45) Date of Patent: Mar. 3, 2020

(54) AXIAL FAN AND OUTDOOR UNIT INCLUDING THE SAME

(71) Applicant: FUJITSU GENERAL LIMITED, Kanagawa (JP)

(72) Inventor: Hirotaka Sawada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 122 days.

(21) Appl. No.: 15/607,828

(22) Filed: May 30, 2017

(65) Prior Publication Data

US 2018/0087784 A1 Mar. 29, 2018

(30) Foreign Application Priority Data

Sep. 27, 2016 (JP) ..... 2016-188109

(51) Int. Cl.

| | |
|---|---|
| ***F24F 1/06*** | (2011.01) |
| ***F04D 29/18*** | (2006.01) |
| ***F04D 29/38*** | (2006.01) |
| ***F04D 29/68*** | (2006.01) |
| ***F04D 29/32*** | (2006.01) |

(Continued)

(52) U.S. Cl.

CPC ..... *F24F 1/06* (2013.01); *F04D 29/181* (2013.01); *F04D 29/325* (2013.01); *F04D 29/38* (2013.01); *F04D 29/384* (2013.01); *F04D 29/388* (2013.01); *F04D 29/4226* (2013.01); *F04D 29/681* (2013.01); *F24F 7/007* (2013.01); *F05D 2240/126* (2013.01); *F05D 2240/304* (2013.01); *F05D 2300/43* (2013.01)

(58) Field of Classification Search

CPC ..... F04D 29/181; F04D 29/325; F04D 29/38; F04D 29/384; F04D 29/388; F24F 1/06

See application file for complete search history.

(56) References Cited

U.S. PATENT DOCUMENTS

2014/0341748 A1* 11/2014 Kojima ..... F04D 29/023 416/234

FOREIGN PATENT DOCUMENTS

| | | | |
|---|---|---|---|
| CN | 102588339 | A | 7/2012 |
| EP | 2784328 | A1 | 10/2014 |
| JP | 02061400 | A * | 3/1990 |

(Continued)

OTHER PUBLICATIONS

Extended European Search Report dated Dec. 18, 2017 issued in European Patent Application No. 17176027.5.

*Primary Examiner* — Kevin A Lathers

(74) *Attorney, Agent, or Firm* — McDermott Will & Emery LLP

(57) ABSTRACT

An axial fan includes: a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part; a rib in a blade surface of the each of the plurality of blades, the rib extending from the hub toward an outer circumference of the each of the plurality of blades along the front edge part; and a first thickness-reduced part adjacent to an end of the rib, the end of the rib being closer to the outer circumference, the each of the plurality of blades being thinned in the first thickness-reduced part.

10 Claims, 5 Drawing Sheets

(51) Int. Cl.
*F04D 29/42* (2006.01)
*F24F 7/007* (2006.01)

(56) References Cited

FOREIGN PATENT DOCUMENTS

| | | | |
|---|---|---|---|
| JP | H08-189497 | A | 7/1996 |
| JP | 2011-074817 | A | 4/2011 |

* cited by examiner

AXIAL FAN AND OUTDOOR UNIT INCLUDING THE SAME

CROSS-REFERENCE TO RELATED APPLICATION

This application claims priority from Japanese Patent Application No. 2016-188109 filed with the Japan Patent Office on Sep. 27, 2016, the entire contents of which are hereby incorporated by reference.

BACKGROUND

1. Technical Field

The present disclosure relates to an axial fan and an outdoor unit.

2. Description of the Related Art

There has been known an axial fan that include, e.g., a hub having a plurality of blades integrally molded therewith in a circumferential direction of the hub, where the axial fan is formed by injection-molding of a molding material such as a resin or metal. This axial fan is formed in the following manner, for example. A molding material is injected into a molding die from a position of the die corresponding to a part of a hub. The molding material is then flown from an inner circumference side of the blades to an outer circumference side of the blades. For this type of axial fan, the following technique is known. That is, according to the technique, in order to reduce a weight of the blades, a thickness-reduced part (cored-out part), which is a part having a thin thickness, is partially provided in a blade surface of each blade.

There has been known another type of axial fan including blades each having a rear edge part (in a rotational direction of the blade) having a cutout extending toward a front edge part of the blade. Thus, the rear edge part is divided by the cutout into an outer rear edge part (a rear edge part closer to an outer circumference of the blade) and an inner rear edge part (a rear edge part closer to an inner circumference of the blade). In such an axial fan, a vortex that has occurred in the front edge part of the blade is flown from the front edge part to the rear edge part along a blade surface of the blade, and is then caught and held by the cutout. This suppresses or reduces fluctuation and development of the vortex, thereby suppressing or reducing a noise caused by the flow of the air.

There has been known further another type of axial fan including blades each having a rear edge part having a plurality of grooves extending from the rear edge part toward a front edge part of the blade. In the axial fan, a vortex that has occurred in the rear edge part of the blade is finely divided for reducing a noise caused by the flow of the air.

This technique is disclosed by, for example, JP-A-8-189497.

SUMMARY

An axial fan includes: a hub; a plurality of blades arranged in a circumferential direction of the hub; a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part; a rib in a blade surface of the each of the plurality of blades, the rib extending from the hub toward an outer circumference of the each of the plurality of blades along the front edge part; and a first thickness-reduced part adjacent to an end of the rib, the end of the rib being closer to the outer circumference, the each of the plurality of blades being thinned in the first thickness-reduced part.

DESCRIPTION OF THE EMBODIMENTS

Figure 1:
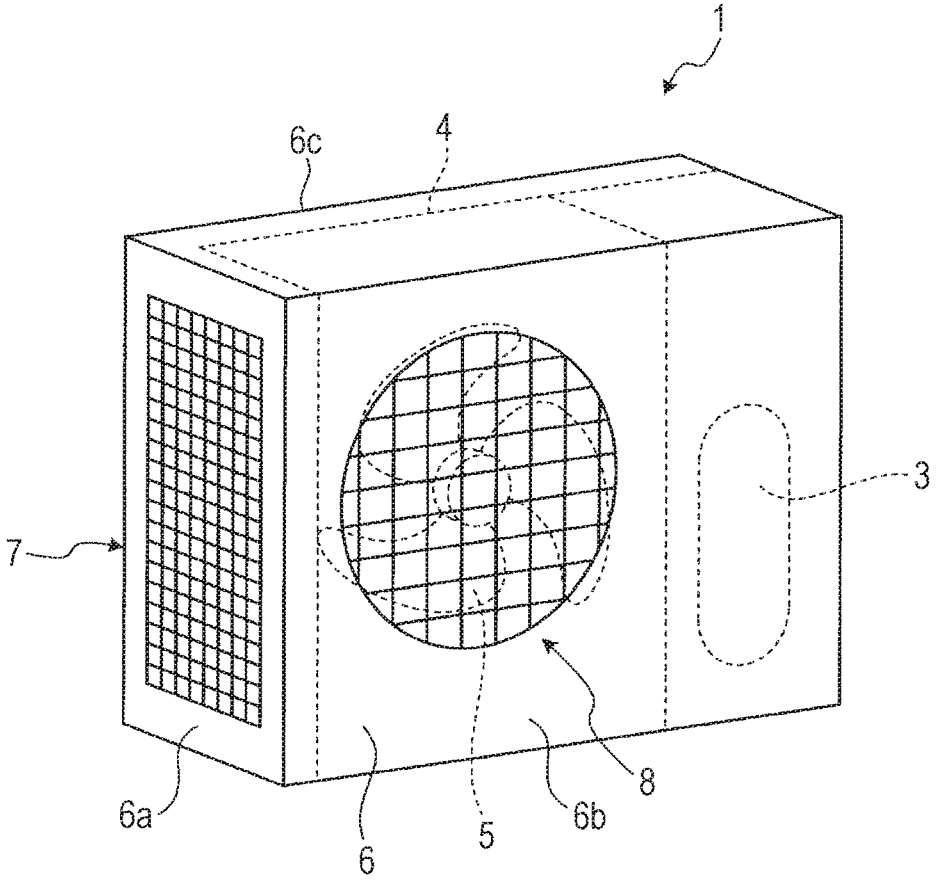
FIG. 1 is a diagram schematically illustrating an outdoor unit according to an embodiment of the present disclosure including an axial fan.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically illustrated in order to simplify the drawing.

Incidentally, with the axial fan including the blades each having the rear edge part having the cutout, the following case may occur. In a process for molding the axial fan such that the axial fan has a thickness-reduced part in a blade surface of each blade, a flow resistance of a molding material is increased in a part of a molding die corresponding to the thickness-reduced part, which is thin. Meanwhile, in a process for molding the axial fan such that the axial fan has a cutout in the rear edge part of each blade (i.e., an edge of each blade), a molding material is hard to flow into a part of a die corresponding to the rear edge part, which has a complicated shape. This may cause a molding failure, and consequently a desired blade shape may not be achieved. Especially, in a process for molding the axial fan such that the axial fan has a plurality of grooves in the rear edge part of each blade, a molding material is hard to flow into a part of a die corresponding to the grooves in the rear edge part. This causes an outstanding molding failure. Thus, for the blade having the rear edge part having the cutout, it has been difficult to succeed both in reducing a weight and in enhancing moldability.

An object of the technique according to the present disclosure is to provide an axial fan having a blade with a reduced weight and improved moldability and an outdoor unit including the axial fan.

An axial fan according to a first aspect of the present disclosure includes: a hub; a plurality of blades arranged in a circumferential direction of the hub; a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part; a rib in a blade surface of the each of the plurality of blades, the rib extending from the hub toward an outer circumference of the each of the plurality of blades along the front edge part; and a first thickness-reduced part adjacent to an end of the rib, the end of the rib being closer to the outer circumference, the each of the plurality of blades being thinned in the first thickness-reduced part.

An axial fan according to a second aspect of the present disclosure includes: a hub; a plurality of blades arranged in a circumferential direction of the hub; a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part; a first thickness-increased part in a blade surface of the each of the plurality of blades, the first thickness-increased part being closer to the front edge part than a tangent line is, the tangent line extending through a rotational center of the hub and being in contact with a valley part of the cutout, the valley part being closer to the front edge part than any other parts of the cutout, the first thickness-increased part extending from an inner circumference of the each of the plurality of blades toward an outer circumference of the each of the plurality of blades; a first thickness-reduced part being adjacent to a part of the first thickness-increased part, the part being closer to the front edge part, the each of the plurality of blades being thinned in the first thickness-reduced part; and a second thickness-reduced part being adjacent to a part of the first thickness-increased part, the part being closer to the rear edge part, the each of the plurality of blades being thinned in the second thickness-reduced part.

An axial fan according to a third aspect of the present disclosure includes: a hub; a plurality of blades arranged in a circumferential direction of the hub; a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part; a plurality of grooves in a part of the inner rear edge part, the part of the inner rear edge part being adjacent to the cutout, the plurality of grooves being arranged along the inner rear edge part, penetrating through the each of the plurality of blades in a thickness direction of the each of the plurality of blades, and extending toward the front edge part; and a second thickness-reduced part in the blade surface of the each of the plurality of blades, the second thickness-reduced part being extending from the hub toward an outer circumference of the each of the plurality of blades while retaining a predetermined distance from the inner rear edge part, the each of the plurality of blades being thinned in the second thickness-reduced part.

According to the above aspect of the axial fan of the present disclosure, it is possible to reduce a weight of the blade and to enhance moldability of the blade.

With reference to the drawings, the following provides a detailed description of embodiments of an axial fan and an outdoor unit according to the present disclosure. Note that the axial fan and the outdoor unit according to the present disclosure are not limited by the below-described embodiments.

Embodiments (Configuration of Outdoor Unit)

FIG. 1 is a diagram schematically illustrating an outdoor unit according to an embodiment of the present disclosure including an axial fan. As illustrated in FIG. 1, an outdoor unit 1 of the embodiment is an outdoor unit for use in an air conditioner. The outdoor unit 1 includes a compressor 3 for compressing a refrigerant, a heat exchanger 4 which is connected to the compressor 3 and through which the refrigerant flows, an axial fan 5 for sending air to the heat exchanger 4, and a housing 6 for accommodating, in its inside, the compressor 3, the heat exchanger 4, and the axial fan 5.

The housing 6 has inlets 7 for taking in ambient air and an outlet 8 for discharging air from the housing 6. The inlets 7 are provided in a side surface 6*a* and a back surface 6*c* of the housing 6. The outlet 8 is provided in a front surface 6*b* of the housing 6. The heat exchanger 4 is disposed over the side surface 6*a* and the back surface 6*c*, which faces the front surface 6*b* of the housing 6. The axial fan 5 is disposed so as to face the outlet 8, and is configured to be rotationally driven by a fan motor (not illustrated).

(Configuration of Axial Fan)

Figure 2:
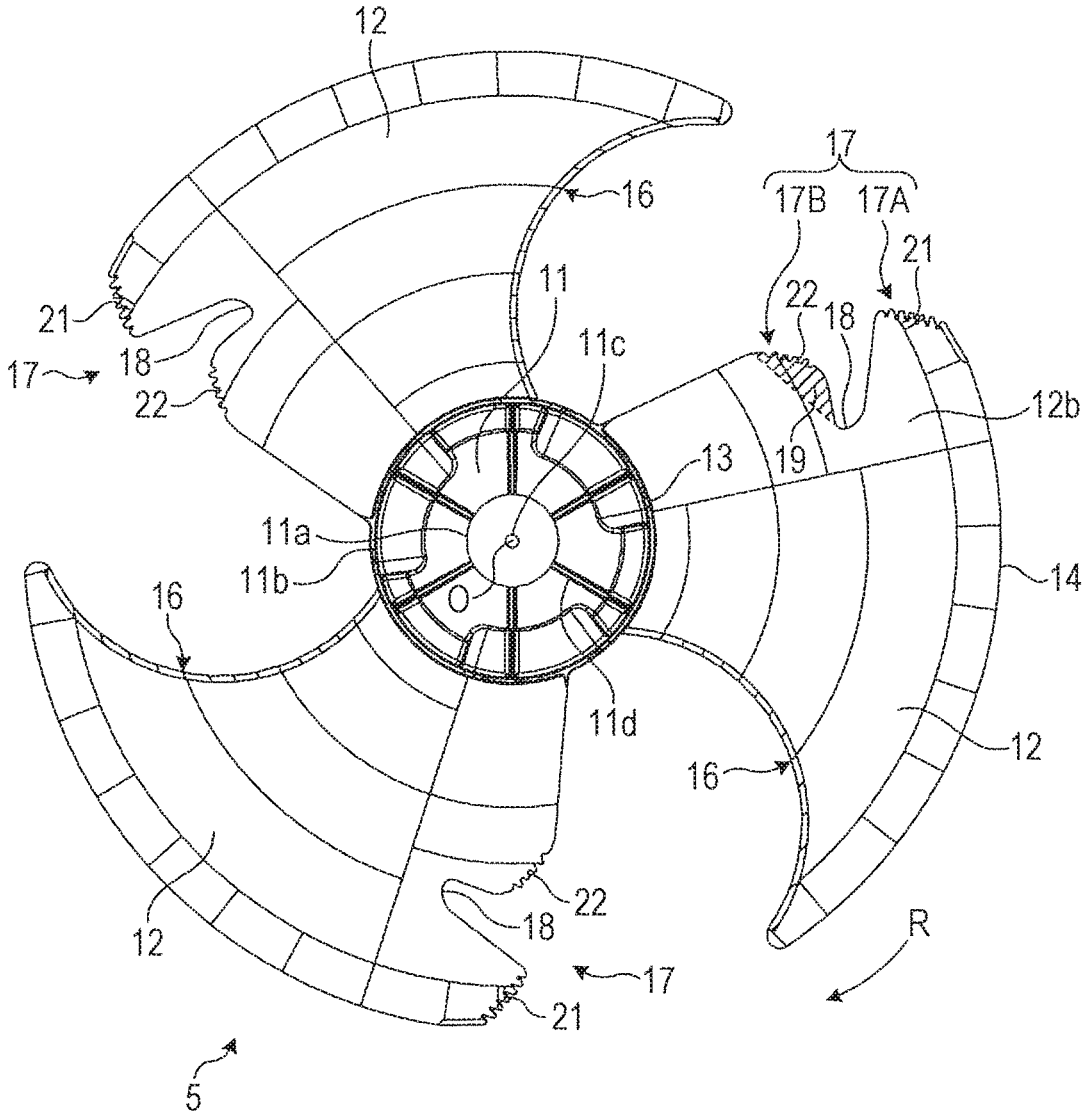
FIG. 2 is a plane view of the axial fan according to the embodiment, when viewed in a positive pressure surface side.
Figure 3:
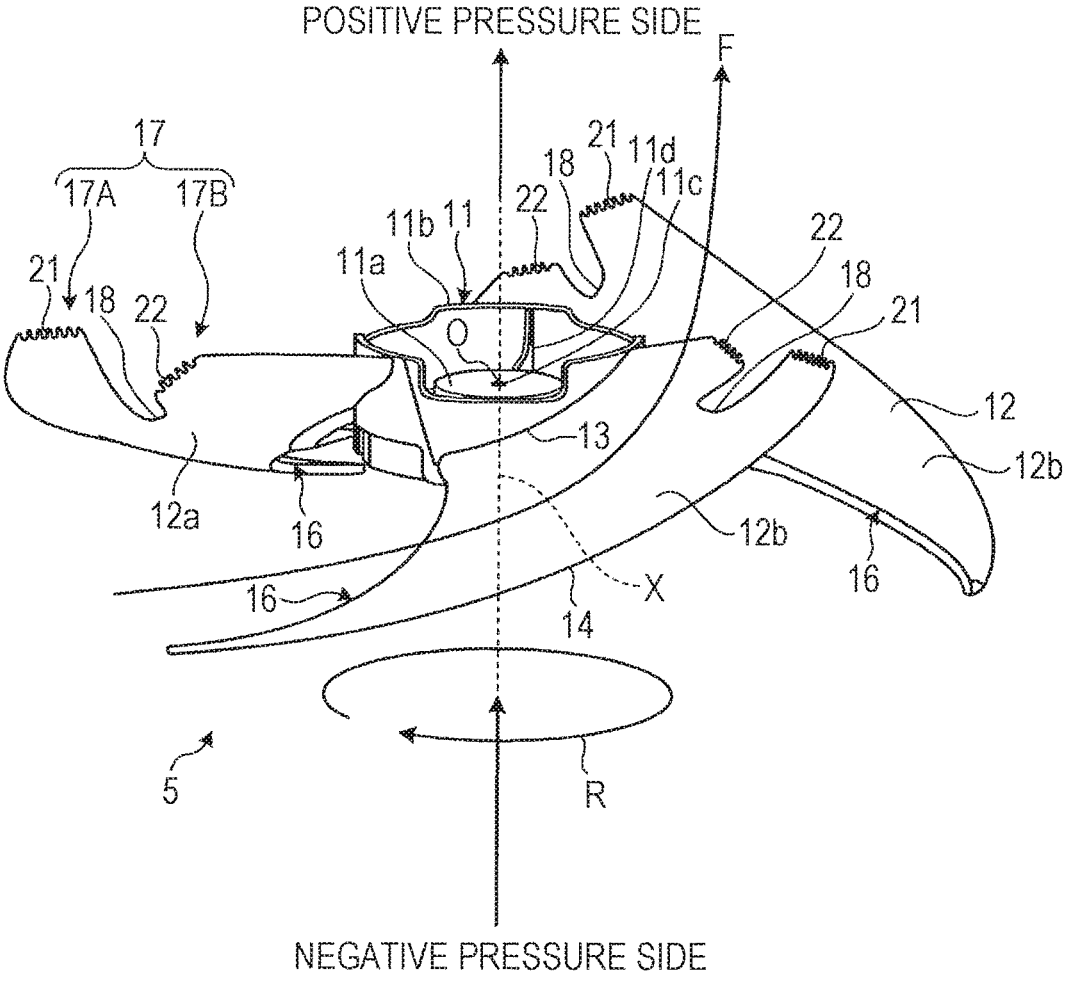
FIG. 3 is a perspective view of the axial fan according to the embodiment.

FIG. 2 is a plane view of the axial fan 5 according to the embodiment, when viewed in a positive pressure surface side. FIG. 3 is a perspective view of the axial fan. 5 according to the embodiment. As illustrated in FIGS. 2 and 3, the axial fan 5 includes a hub 11 having a substantially cylindrical shape and a plurality of blades 12 arranged in a circumferential direction of the hub 11. The axial fan 5 is made of a molding material, e.g., a resin material, and is formed as a single piece. The hub 11 is formed in a bicylindrical shape having an inner cylinder 11*a* and an outer cylinder 11*b*, which is disposed to face an outer circumferential surface of the inner cylinder 11*a*. The inner cylinder 11 a has a shaft hole 11*c* into which a rotational shaft (not illustrated) of the fan motor is to be fitted. The outer circumferential surface of the inner cylinder 11*a* is formed integrally with an inner circumferential surface of the outer cylinder 11*b* such that a plurality of ribs 11*d* arranged radially is interposed between the outer circumferential surface of the inner cylinder 11*a* and the inner circumferential surface of the outer cylinder 11*b*. An outer circumferential surface of the outer cylinder lib has three blades 12 formed integrally therewith and arranged at a certain distance along a circumferential direction of the outer cylinder 11*b*.

(Shape of Blade of Axial Fan)

Figure 4:
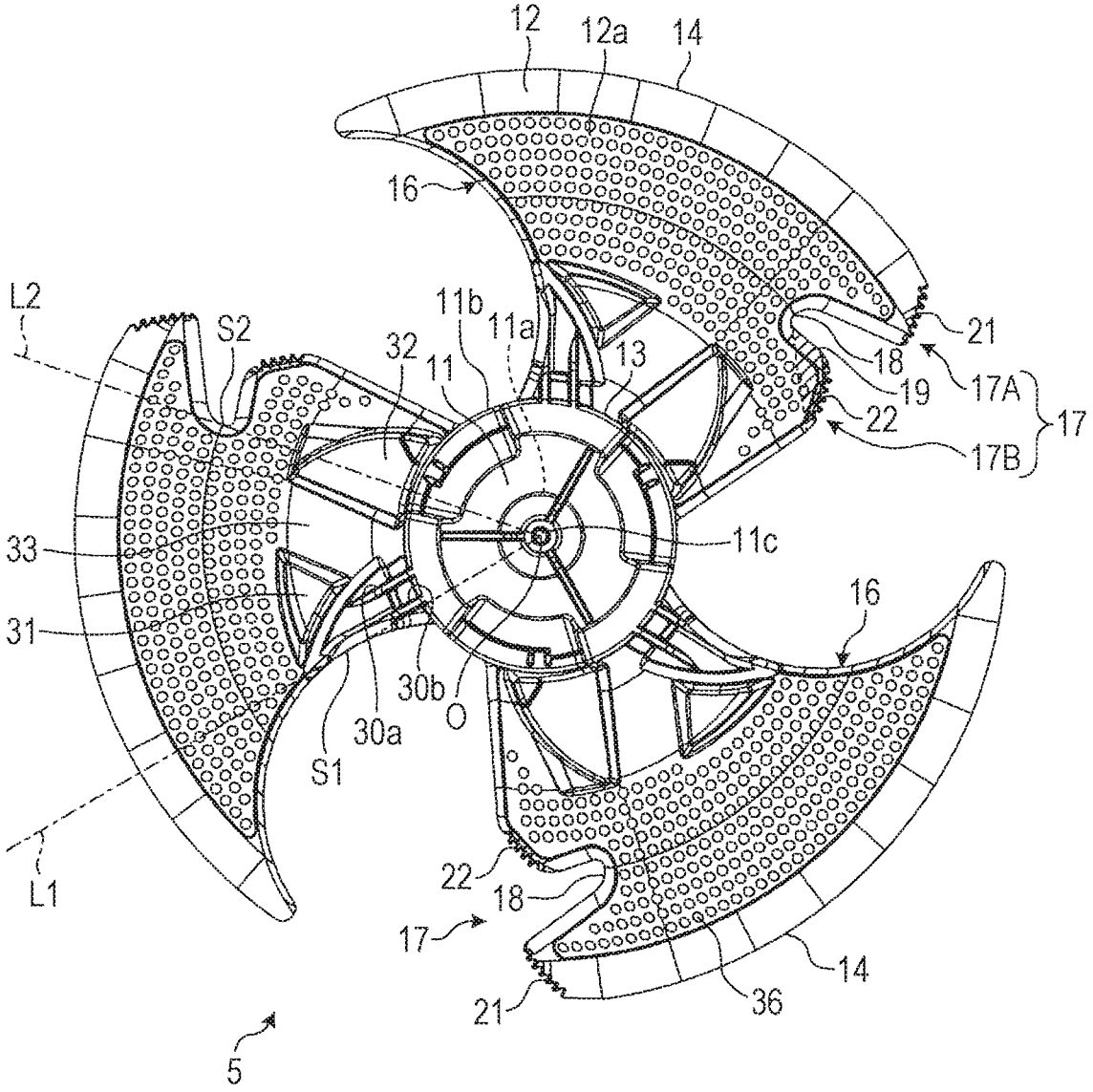
FIG. 4 is a plane view of blades of the axial fan according to the embodiment, when viewed in a negative pressure surface side.
Figure 5:
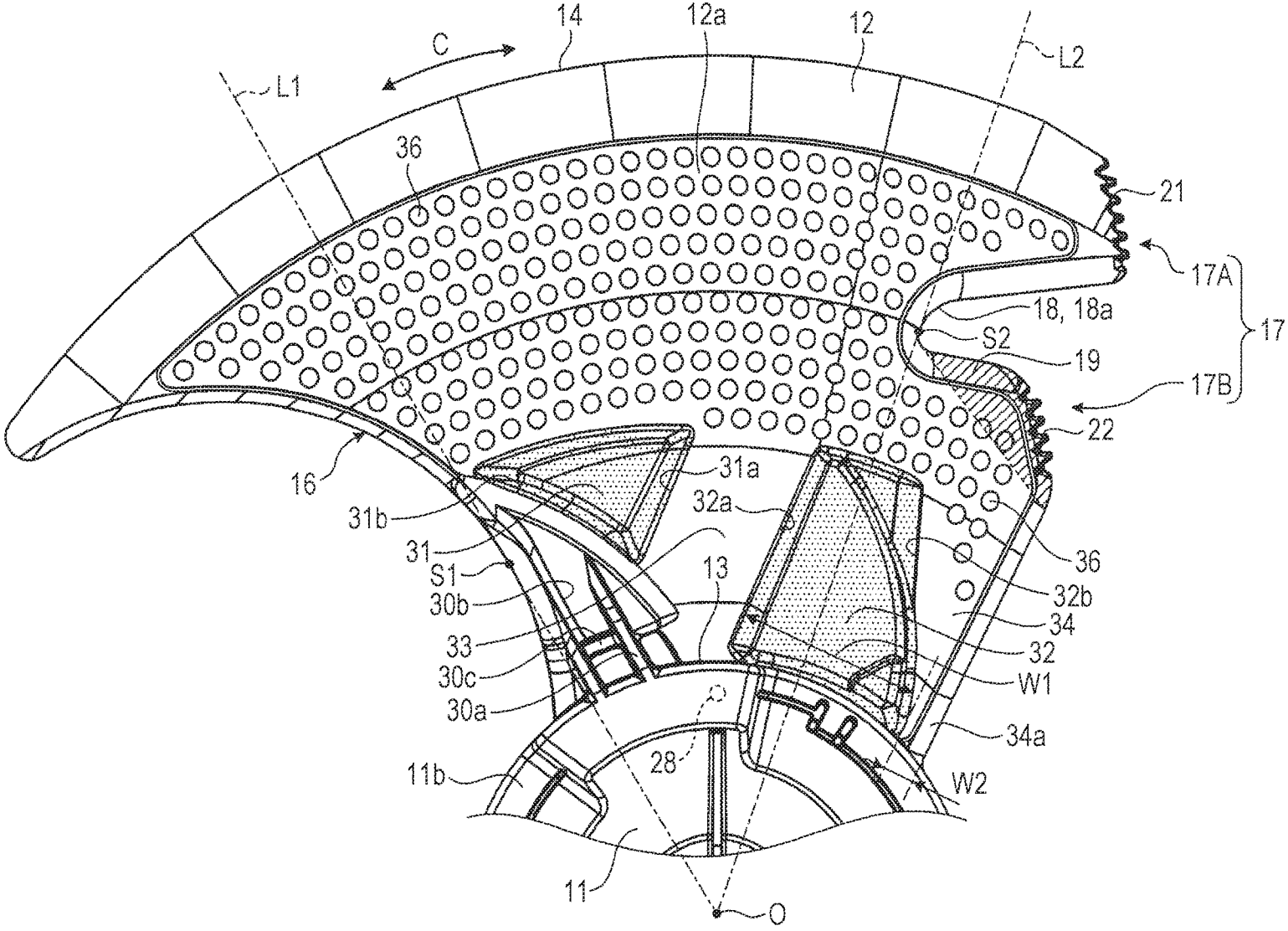
FIG. 5 is an enlarged plane view of the blade of the axial fan according to the embodiment, when viewed in the negative pressure surface side.

FIG. 4 is a plane view of the axial fan according to the embodiment, when viewed in a negative pressure surface side. FIG. 5 is an enlarged plane view of the blade of the axial fan according to the embodiment, when viewed in the negative pressure surface side.

As illustrated in FIG. 3, each of the blades 12 is formed in a plate shape. As illustrated in FIGS. 2 and 4, the blade 12 is formed to have an inner circumferential edge 13, which is connected to the outer cylinder 11*b* of the hub 11, and an outer circumferential edge 14, which is on a line extended in a radial direction of the hub 11. The outer circumferential edge 14 is wider than the inner circumferential edge 13. The blade 12 has a front edge part 16, which is located in a front side in a rotational direction of the blade 12. The front edge part 16 is formed to be curved toward a rear edge part 17, which is located in an opposite side to the front edge part 16. The front edge part 16 is curved when viewed in a rotational axis direction X. Furthermore, as illustrated in FIG. 3, a surface (blade surface) of the blade 12 is formed such that a line extending from the front edge part 16 to the rear edge part 17 along the circumferential direction of the hub 11 is gently curved from a negative pressure side of the axial fan 5 to a positive pressure side of the axial fan 5. When the axial fan 5 having the blades 12 formed as above is rotated in a direction R (FIG. 3), air flows from the negative pressure side to the positive pressure side. Hereinafter, a blade surface of each blade 12 on the negative pressure side is referred to as a "negative pressure surface 12*a*", and a blade surface of each blade 12 on the positive pressure side is referred to as a "positive pressure surface 12*b*".

As illustrated in FIGS. 2, 3, and 4, the rear edge part 17 of each blade 12 has a cutout 18 by which the rear edge part 17 is divided into an outer rear edge part 17A and an inner rear edge part 17B. The cutout 18 is formed so as to extend from the rear edge part 17 of the blade 12 toward the front edge part 16 of the blade 12. Furthermore, the cutout 18 has a substantial V-shape that is tapered toward the front edge part 16 when viewed in the rotational axis direction X. As indicated by the hatched areas in FIGS. 2, 4, and 5, the inner rear edge part 17B has a protrusion 19 that protrudes toward the cutout 18 and is shaped in a substantial triangle. The protrusion 19 has a continuous surface extending along the positive pressure surface 12*b* of the blade 12.

As indicated by the arrow F in FIG. 3, over the positive pressure surface 12*b* of the blade 12, air flows from the front edge part 16 toward the rear edge part 17 in a circumferential direction C (see FIG. 5) of the huh 11. The greater the number of revolutions of the axial fan 5, the greater the amount of air flowing in a centrifugal direction, which is a radial direction of the hub 11.

A part (a centrifugal element of the air) of the air flowing in the centrifugal direction over the positive pressure surface 12*b* of the blade 12 flows toward the negative pressure surface 12*a* through the cutout 18 of the rear edge part 17. In the embodiment, a surface of the protrusion 19 of the inner rear edge part 17B extends along the positive pressure surface 12*b* continuously. This reduces a flow rate of the centrifugal element of the air that flows toward the negative pressure surface 12*a* through the cutout 18. Thus, by reducing the flow rate of the centrifugal element of the air that flows from the cutout 18 toward the negative pressure surface 12*a*, the centrifugal element of the air is effectively used, and thus an amount of air generated by the axial fan 5 is increased.

In the axial fan 5, a wind speed in the inner rear edge part 17B tends to be lower than a wind speed in the outer rear edge part 17A. As the wind speed becomes lower, an effect of a centrifugal force caused by the rotation of the blade 12 is more likely to occur. Due to the effect of the centrifugal force, an airflow direction in the outer rear edge part 17A and an airflow direction in the inner rear edge part 17B become different from each other. Specifically, the airflow direction in the inner rear edge part 17B is inclined toward the outer circumference more, as compared to the airflow direction in the outer rear edge part 17A.

As illustrated FIGS. 4 and 5, the outer rear edge part 17A has a part which is adjacent to the cutout 18 and in which a first groove part 21 including a plurality of grooves is provided along the outer rear edge part 17A. The plurality of grooves of the first groove part 21 penetrates through the blade 12 in a thickness direction of the blade 12, and extends toward the front edge part 16. Meanwhile, the inner rear edge part 17B has a part which is adjacent to the cutout 18 and in which a second groove part 22 including a plurality of grooves is provided along the inner rear edge part 17B. The plurality of grooves of the second groove part 22 penetrates through the blade 12 in the thickness direction of the blade 12, and extends toward the front edge part 16. The second groove part 22 is disposed in the protrusion 19, which is included in the inner rear edge part 17B. The second groove part 22 is disposed along an outer edge of the protrusion 19, which is located in an opened part of the substantially V-shaped cutout 18.

The first groove part 21 and the second groove part 22 have different shapes when viewed in the rotational axis direction X of the hub 11. Note that there are differences between the first groove part 21 and the second groove part 22 other than the shape viewed in the rotational axis direction X. For example, the first groove part and the second groove part 22 have different shapes when viewed in the positive pressure surface 12*b*, too. As such, the first groove part 21 and the second groove part 22 have respective shapes having different depths, different pitches, and/or the like according to the wind speeds in the respective positions where they are provided (the outer rear edge part 17A and the inner rear edge part 17B). This makes it possible to appropriately suppress or reduce a noise caused by the flow of the air.

An angle of the second groove part 22 made by a direction (depth direction) of the second groove part 22, the direction extending from the rear edge part 17 toward the front edge part 16, and the radial direction of the hub 11 of the second groove part 22 is smaller than an angle of the first groove part 21 made by the depth direction of the first groove part 21 and the radial direction of the hub 11 of the first groove part 21. These angles are set based on the airflow direction in the outer rear edge part 17A and the airflow direction in the inner rear edge part 17B. Namely, the first groove part 21 extends along the airflow direction in the outer rear edge part 17A. Similarly, the second groove part 22 extends along the airflow direction in the inner rear edge part 17B. As such, the first groove part 21 and the second groove part 22 are formed in suitable shapes according to the airflow directions in respective positions of the rear edge part 17 where the first groove part 21 and the second groove part 22 are provided. Thus, the first groove part 21 and the second groove part 22 finely divide a vortex occurring in the rear edge part 17 in an effective manner. This enhances the effect of reducing a noise caused by the flow of the air.

(Arrangement of Thickness-Reduced Parts in Blade)

As illustrated in FIGS. 4 and 5, a first thickness-reduced part 31 and a second thickness-reduced part 32, each of which is a part having a thin thickness, are provided on the negative pressure surface 12*a* (the blade surface) of each blade 12. In other words, each of the first thickness-reduced part 31 and the second thickness-reduced part 32 is a recess that is formed in a part of the negative pressure surface 12*a* of the blade 12 and has a predetermined shape, and is a cored-out part formed in the thickness direction of the blade 12.

As illustrated in FIG. 5, the negative pressure surface 12*a* of the blade 12 has a first rib 30*a* and a second rib 30*b* each extending from the hub 11 toward an outer circumference of the blade 12 along the front edge part 16. The negative pressure surface 12*a* has the first thickness-reduced part 31 adjacent to ends of the first rib 30*a* and the second rib 30*b*, the ends are closer to the outer circumference. The first thickness-reduced part 31 is formed on the negative pressure surface 12*a* so as to be shaped in a substantial triangle. The first thickness-reduced part 31 has two side surfaces 31*a* and 31*b* arranged such that a distance between the side surfaces 31*a* and 31*b* becomes larger as parts of the side surfaces 31*a* and 31*b* where the distance is measured are closer to the outer circumferential edge 14 of the blade 12.

The first rib 30*a* and the second rib 30*b* extend so as to be substantially parallel to each other along a first tangent line L1 from the inner circumferential edge 13 of the blade 12 toward the outer circumferential edge 14 of the blade 12. The first tangent line L1 is a straight line that extends through a rotational center O of the hub 11 and is in contact with, at a first tangent point S1, an outer edge of the front edge part 16, which is curved. The first rib 30*a* and the second rib 30*b* have respective ends connected to the outer circumferential surface of the outer cylinder 11*b* of the hub 11. The first rib 30*a* and the second rib 30*b* are connected via a connecting member 30*c*, which extends in the circumferential direction of the hub 11.

The first rib 30*a*, the second rib 30*b*, and the connecting member 30*c* make the blade 12 partially thicker, and thus have a function of reinforcing the inner circumferential edge 13 of the blade 12. The first rib 30*a* and the second rib 30*b* respectively have recesses surrounding the first rib 30*a* and the second rib 30*b*, and these recesses also serve as the thickness-reduced parts. Note that, in a molding die at the time of molding of the axial fan 5, a molding material flows from a part of the die corresponding to the inner circumferential edge 13 of the blade 12 toward a part of the die corresponding to the outer circumferential edge 14. During this, the molding material flows through parts of the die corresponding to the first rib 30*a* and the second rib 30*b* at a higher speed than those in other parts of the die, since the first rib 30*a* and the second rib 30*b* are thick. Note that the embodiment includes the two first rib 30*a* and second rib 30*b*. However, the number of ribs is not limited to this. Depending on a condition for the molding, one rib or three or more ribs may be provided.

The negative pressure surface 12*a* of the blade 12 has the second thickness-reduced part 32. There provided a second thickness-increased part 34 between the second thickness-reduced part 32 and the inner rear edge part 17B. The second thickness-increased part 34 has a flow-speed increasing part 34*a*. Between the second thickness-reduced part 32 and the inner rear edge part 17B, the flow-speed increasing part 34*a* has a predetermined width W2. On the negative pressure surface 12*a*, the second thickness-reduced part 32 is shaped in a substantial trapezoid, and has side surfaces 32*a* and 32*b*. A distance W1 between the side surface 32*a* and the side surface 32*b* is reduced as parts of the side surface 32*a* and the side surface 32*b* where the distance W1 is measured are located closer to the outer circumferential edge 14 than the inner circumferential edge 13. The second thickness-reduced part 32 is positioned so as to be adjacent to the outer circumferential surface of the outer cylinder 11*h* of the hub 11 and to overlap a second tangent line L2 (described later).

The second thickness-increased part 34 is thicker than the second thickness-reduced part 32, which is adjacent thereto. Thus, a part of the die corresponding to the second thickness-increased part 34 is a portion where a flow resistance of the molding material during the molding is low and the molding material is easy to flow. The second thickness-increased part 34 is configured to have a small width. This allows the molding material to flow at a higher speed during the molding Since the molding material flows at a higher speed, the molding material that has passed through the part of the die corresponding to the second thickness-increased part 34 easily spreads to parts of the die corresponding to the cutout 18, the protrusion 19, and the second groove part 22. The predetermined width W2 of the flow-speed increasing part 34*a* is set so as to allow the molding material that has passed through the part of the die corresponding to the second thickness-increased part 34 to achieve a flow speed with which the molding material easily spreads to the parts of the die corresponding the cutout 18, the protrusion 19, and the second groove part 22.

During the molding of the axial fan 5, the following state occurs in the blade 12 due to the flow-speed increasing part 34*a* (the part having the width W2). That is, inside the molding die, a speed of the molding material flowing from the part of the die corresponding to the inner circumferential edge 13 toward a part of the die corresponding to the inner rear edge part 17B is higher than a speed of the molding material flowing through a part of the die corresponding to the second thickness-reduced part 32, which is adjacent to the inner rear edge part 17B. Thanks to the small width W2 of the flow-speed increasing part 34*a*, the flow speed of the molding material during the molding of the axial fan 5 is increased. The width W2 is set according to an external shape of the rear edge part 17 of the blade 12. Especially, the width W2 is set depending on a molding condition determined according to the shapes of the second groove part 22 of the inner rear edge part 17B and the protrusion 19. A distance between the side surface 32*b* of the second thickness-reduced part 32 and the inner rear edge part 17B is minimum at the width W2 in the flow-speed increasing part 34*a*, and the distance increases as it gets closer to the outer circumferential edge 14 than the inner circumferential edge 13. This properly determines flow of the molding material during the molding, thereby allowing the molding material to spread to the parts of the die corresponding to the cutout 18, the protrusion 19, and the second groove part 22.

The negative pressure surface 12*a* of the blade 12 has a first thickness-increased part 33 positioned so as to be closer to the front edge part 16 than the second tangent line L2 is and to extend from the inner circumferential edge 13 of the blade 12 toward the outer circumferential edge 14 of the blade 12. The second tangent line L2 is a straight line that extends in the radial direction of the hub 11 so as to extend through the rotational center O of the hub 11 and be in contact with a valley part 18*a* at a second tangent point S2. The valley part 18*a* is a part of an outer edge of the cutout 18, the part being closer to the front edge part 16 than any other parts of the cutout 18.

The first thickness-increased part 33 is interposed between the first thickness-reduced part 31 and the second thickness-reduced part 32 on the negative pressure surface 12*a*. The second thickness-reduced part 32 is formed so as to be close to the inner rear edge part 17B. The first thickness-reduced part 31 and the second thickness-reduced part 32 respectively have the side surfaces 31*a* and 32*a*, which are substantially parallel to each other. Thus, between the first thickness-reduced part 31 and the second thickness-reduced part 32, the first thickness-increased part 33 is formed in a substantial belt-shape extending from the hub 11 toward the outer circumferential edge 14. The first thickness-increased part 33 has an end that is closer to the inner circumferential edge 13. The end of the first thickness-increased part 33 is partially connected to the outer circumferential surface of the outer cylinder 11*b* of the hub 11, and is partially adjacent to a region including the first rib 30*a* and the second rib 30*b*.

The first thickness-increased part 33 is a region which is included in the negative pressure surface 12*a* of the blade 12 and which does not have a thickness-reduced part or a recess. The first thickness-increased part 33 is thicker than the first thickness-reduced part 31 and the second thickness-reduced part 32, which are adjacent to the first thickness-increased part 33. Thus, a flow resistance of the molding material during the molding of the axial fan 5 is low in a part of the die corresponding to the first thickness-increased part 33. Therefore, the part of the die corresponding to the first thickness-increased part 33 is a portion through which the molding material is easy to flow.

Furthermore, as illustrated in FIG. 5, there provided a plurality of dimples 36 over a region from the front edge part 16 to the rear edge part 17 on the negative pressure surface 12*a* of the blade 12. Each of the dimples 36 is a recess having a cross-section of an arc-shape. The dimples 36 are arranged at a predetermined distance in the radial direction and the circumferential direction of the hub 11. When the blade 12 is rotated, the dimples 36 cause a secondary flow of the air inside the dimples 36. With this, the dimples 36 suppress or reduce development of a boundary layer of the airflow, and accordingly suppress or reduce a noise occurring due to a pressure fluctuation caused by separation of the boundary layer. Namely, the dimples 36 have a function of suppressing or reducing occurrence of a noise by suppressing or reducing occurrence of the boundary layer separation on the negative pressure surface 12*a*, and a function as the thickness-reduced part similar to those of the first and second thickness-reduced parts 31 and 32.

In the first thickness-increased part 33 according to the embodiment, the side surface 31*a* of the first thickness-reduced part 31, which is located closer to the front edge part 16, and the side surface 32*a* of the second thickness-reduced part 32, which is located closer to the rear edge part 17, are formed so as to be substantially parallel to each other when viewed in a direction orthogonal to the negative pressure surface 12*a*. However, the shape of the first thickness-increased part 33 is not limited to this. Alternatively, for example, the first thickness-increased part 33 may have a shape whose distance between the side surface 31*a* of the first thickness-reduced part 31 and the side surface 32*a* of the second thickness-reduced part 32 is increased as parts of the side surface 31*a* and the side surface 32*a* where the distance is measured are located closer to the outer circumferential edge 14 or reduced as these parts are located closer to the outer circumferential edge 14. The shape of the first thickness-increased part 33 is set, for example, depending on a condition for flowing the molding material from the part of the die corresponding to the inner circumferential edge 13 of the blade 12 toward the part of the die corresponding to the outer circumferential edge 14 of the blade 12, where the condition is set according to the external shape of the blade 12.

(Flow of Molding Material during Molding of Blade)

The molding die (not illustrated) for the above-described axial fan 5 has a gate 28 located in a position corresponding to an end surface of the outer cylinder 11*b* of the hub 11 (see FIG. 5). The gate 28 is used to inject a molten molding material therethrough into a cavity for molding the axial fan 5. For example, the gate 28 is disposed in the rotational axis direction X (see FIG. 3) toward the hub 11. The axial fan 5 is formed by (i) injecting the molding material into the molding die through the gate 28 such that the molding material flows from the part of the die corresponding to the inner circumferential edge 13 of the blade 12 toward the part of the die corresponding to the outer circumferential edge 14 of the blade 12 through a part of the die corresponding to the hub 11 and (ii) filling the cavity with the molding material.

The molding material flows along the parts of the die corresponding to the first rib 30*a* and the second rib 30*b*, which serve as flow passages in the molding die, such that the molding material flows from a part of the die corresponding to a part of the inner circumferential edge 13 being closer to the front edge part 16 toward the part of the die corresponding to the outer circumferential edge 14. Thanks to a part of the die corresponding to the first thickness-reduced part 31, in which the flow resistance in the molding die becomes higher, the molding material that has flowed along the parts of the die corresponding to the first rib 30*a* and the second rib 30*b* is properly dispersed to a portion having a relatively low flow resistance. Thus, the molding material that has passed through the parts of the die corresponding to the first rib 30*a* and the second rib 30*b* flows through a part of the die corresponding to the front edge part 16, which is shaped in an arc, and then appropriately flows into the part of the die corresponding to the outer circumferential edge 14, which extends forward. Thus, it is possible to accurately form an external shape of the front edge part 16. As such, the first thickness-reduced part 31 is adjacent to the ends of the first rib 30*a* and the second rib 30*b*, the ends being closer to the outer circumference. Thanks to this, even in a case where the flow of the molding material is concentrated to the parts of the die corresponding to the first rib 30*a* and the second rib 30*b* where the blade 12 is thickened, the molding material is properly dispersed to the portion having a relatively lower flow resistance compared to the part of the die corresponding to the first thickness-reduced part 31. This properly adjusts a balance in the flow of the molding material in the part of the die corresponding to the front edge part 16.

Furthermore, the molding material flows through a part of the die corresponding to the part having the width W2 (flow-speed increasing part 34*a*), which is adjacent to the second thickness-reduced part 32, such that the molding material flows from a part of the die corresponding to a part of the inner circumferential edge 13 being closer to the inner rear edge part 17B toward the part of the die corresponding to the outer circumferential edge 14. The molding material flows through the part of the die corresponding to the part having the width W2, which is narrowed by the second thickness-reduced part 32 adjacent thereto. This increases a flow speed of the molding material, thereby facilitating the flow of the molding material into a part of the die corresponding to an outer edge of the inner rear edge part 17B. Thus, in the part of the die corresponding to the inner rear edge part 17B, the molding material flows properly especially into parts of the die corresponding to the cutout 18, the protrusion 19, and the second groove part 22. Thus, it is possible to accurately form an external shape of the inner rear edge part 17B. As such, the second thickness-reduced part 32, which has the predetermined distance W1, is positioned in the blade 12. This properly adjusts the manner in which the molding material flows in a roundabout manner to a part of the die corresponding to the cutout 18 of the inner rear edge part 17B and the vicinity of the cutout 18.

Moreover, in the molding die, the molding material flows along the part of the die corresponding to the first thickness-increased part 33 such that the molding material flows from the part of the die corresponding to the inner circumferential edge 13 toward the part of the die corresponding to the outer circumferential edge 14. The first thickness-increased part 33 is positioned so as to be closer to the front edge part 16 than the second tangent line L2 is. Thus, in the molding die, the molding material properly flows into a part of the die corresponding to the outer rear edge part 17A, while avoiding the part of the die corresponding to the cutout 18, which is a projection that hinders the flow. In addition, the first thickness-increased part 33 is formed between the side surfaces 31*a* and 32*a*, which are substantially parallel to each other. This leads to proper regulation of a flow direction of the molding material passing through the part of the die corresponding to the first thickness-increased part 33. Consequently, the molding material properly flows to the part of the die corresponding to the outer rear edge part 17A in a roundabout manner through a part closer to the front edge part 16 than the cutout 18. Thus, the molding material that has flowed to the part of the die corresponding to the outer rear edge part 17A in a roundabout manner flows properly especially into parts of the die corresponding to the cutout 18 and the first groove part 21. Consequently, it is possible to accurately form an external shape of the outer rear edge part 17A.

In other words, the above-described second thickness-reduced part 32 is formed in a position that does not hinder the flow of the molding material from the part of the die corresponding to the hub 11 toward the part of the die corresponding to the outer rear edge part 17A. Due to the side surface 32*a* included in the second thickness-reduced part 32, the second thickness-reduced part 32 also has a function of adjusting the flow of the molding material passing through the part of the die corresponding to the first thickness-increased part 33. In addition, the first thickness-increased part 33 has the end that is closer to the inner circumferential edge 13 and is adjacent to the first rib 30*a* and the second rib 30*b*. A relatively large amount of molding material flows into the parts of the die corresponding to the first rib 30*a* and the second rib 30*b*. Thus, the molding material flowing through the parts of the die corresponding to the first rib 30*a* and the second rib 30*b* smoothly flows into the part of the die corresponding to the first thickness-increased part 33. Consequently, a flow rate of the molding material flowing into the part of the die corresponding to the outer rear edge part 17A through the part of the die corresponding to the first thickness-increased part 33 is regulated appropriately.

As described above, the negative pressure surface 12*a* of each blade 12 of the axial fan 5 according to the embodiment has the first rib 30*a* and the second rib 30*b*, which extend from the hub 11 toward an outer circumference of the front edge part 16. The first thickness-reduced part 31 is formed so as to be adjacent to the ends of the first rib 30*a* and the second rib 30*b*, the ends being closer to the outer circumference. Consequently, during molding of the axial fan 5, the flow of the molding material passing through the parts of the die corresponding to the first rib 30*a* and the second rib 30*b* is regulated appropriately. Thus, it is possible to accurately form the external shape of the front edge part 16. Therefore, thanks to the first thickness-reduced part 31, the embodiment is able to reduce a weight of the blade 12 and to enhance moldability of the blade 12.

As described above, the negative pressure surface 12*a* of each blade 12 of the axial fan 5 according to the embodiment has the second thickness-reduced part 32. The second thickness-reduced part 32 extends from the hub 11 toward the outer circumferential edge 14 while retaining the predetermined distance W2 from the inner rear edge part 17B. Consequently, during molding of the axial fan 5, the molding material flows through the part of the die corresponding to the part having the width W2 (flow-speed increasing part 34*a*), which is narrowed by the second thickness-reduced part 32 adjacent thereto. This facilitates the flow of the molding material into the part of the die corresponding to the inner rear edge part 17B. The molding material flows properly especially into the parts of the die corresponding to the cutout 18, the protrusion 19, and the second groove part 22. Consequently, it is possible to accurately form the external shape of the inner rear edge part 17B. Therefore, thanks to the second thickness-reduced part 32, the embodiment is able to reduce a weight of the blade 12 and to enhance moldability of the blade 12 having the cutout 18.

Furthermore, as described above, the negative pressure surface 12*a* of each blade 12 of the axial fan 5 according to the embodiment has the first thickness-increased part 33. The first thickness-increased part 33 is interposed between the first thickness-reduced part 31 and the second thickness-reduced part 32, and is positioned so as to be closer to the front edge part 16 than the second tangent line L2 is. On both sides of the first thickness-increased part 33, the first thickness-reduced part 31 and the second thickness-reduced part 32 are formed. Namely, the first thickness-reduced part 31 is formed so as to be adjacent to a part of the first thickness-increased part 33, the part being closer to the front edge part 16. The second thickness-reduced part 32 is formed so as to be adjacent to a part of the first thickness-increased part 33, the part being closer to the rear edge part 17. Consequently, during molding of the axial fan 5, the molding material flows as follows. That is, while avoiding the part of the die corresponding to the cutout 18, which hinders the flow in the molding die, the molding material appropriately flows into the part of the die corresponding to the outer rear edge part 17A through a part of the die corresponding to a part of the first thickness-increased part 33 being closer to the front edge part 16 than the second tangent line L2 is. Thus, it is possible to accurately form the external shape of the inner rear edge part 17B. Therefore, thanks to the first thickness-increased part 33, the embodiment is able to reduce a weight of the blade 12 and to enhance moldability of the blade 12 having the cutout 18.

Moreover, as described above, the first thickness-reduced part 31 and the second thickness-reduced part 32 of the axial fan 5 according to the embodiment respectively have the side surfaces 31*a* and 32*a*, which are substantially parallel to each other. Thanks to this, the flow direction of the molding material passing through the part of the die corresponding to the first thickness-increased part 33 is regulated properly. Thus, the molding material properly flows to the part of the die corresponding to the outer rear edge part 17A in a roundabout manner through the part of the die corresponding to the part closer to the front edge part 16 than the cutout 18. This makes it possible to more accurately form the external shape of the inner rear edge part 17B. Therefore, thanks to the side surfaces 31*a* and 32*a*, the embodiment is able to reduce a weight of the blade 12 and to further enhance moldability of the blade 12.

The embodiment includes the first thickness-reduced part 31, which is adjacent to the first rib 30*a* and the second rib 30*b*, the second thickness-reduced part 32, which has the distance W2 from the inner rear edge part 17B, and the first thickness-increased part 33, which is interposed between the first thickness-reduced part 31 and the second thickness-reduced part 32. However, the configuration of the axial fan according to the embodiment is not limited to this. It is only necessary for the axial fan of the embodiment to include at least one of the first thickness-reduced part 31, the second thickness-reduced part 32, and the first thickness-increased part 33 described above. This brings about an effect of appropriately regulating the flow of the molding material so as to enhance moldability of the blade 12.

According to the embodiment, both of the first thickness-reduced part 31 and the second thickness-reduced part 32 are provided on the negative pressure surface 12*a*. Alternatively, as necessary, both of the first thickness-reduced part 31 and the second thickness-reduced part 32 may be provided on the positive pressure surface 12*b*. Further alternatively, the first thickness-reduced part 31 and the second thickness-reduced part 32 may be provided separately such that the first thickness-reduced part 31 is provided on the negative pressure surface 12*a* and the second thickness-reduced part 32 is provided on the positive pressure surface 12*b*, or vice versa.

The foregoing has explained the embodiments of the present disclosure. Note that the embodiments are not limited by the descriptions above. Furthermore, the above-described elements encompass the ones which are readily understandable by a skilled person, which are substantially identical to the corresponding elements, and which are equivalent to the corresponding elements. Moreover, the above-described elements may be combined as necessary. In addition, the elements may be omitted, substituted, and/or altered in various ways within a range of a gist of the embodiments.

An air conditioner according to an embodiment of the present disclosure may be any one of first to sixth axial fans below or a first outdoor unit below.

The first axial fan includes: a hub; and a plurality of blades arranged in a circumferential direction of the hub, wherein each of the plurality of blades has a cutout in a rear edge part of the blade, the rear edge part being opposite to a front edge part of the blade in a rotational direction of the blade, the cutout extending from the rear edge part toward the front edge part such that the cutout divides the rear edge part into an outer rear edge part and an inner rear edge part, wherein the blade has a blade surface having a rib extending from the hub toward an outer circumference along the front edge part, and wherein a first thickness-reduced part, in which the blade is thinned, is formed so as to be adjacent to an end of the rib, the end being closer to the outer circumference.

The second axial fan is the first axial fan configured such that: the inner rear edge part has a part which is adjacent to the cutout and in which a plurality of grooves is provided along the inner rear edge part, the plurality of grooves penetrating through the blade in a thickness direction of the blade, the plurality of grooves extending toward the front edge part; and the blade surface of the blade has a second thickness-reduced part, in which the blade is thinned, the second thickness-reduced part being extending from the hub toward the outer circumference of the blade while retaining a predetermined distance from the inner rear edge part.

The third axial fan is the second axial fan configured such that the blade surface of the blade has a thickness-increased part being located between the first thickness-reduced part and the second thickness-reduced part such that the thickness-increased part is closer to the front edge part relative to a tangent line extending through a rotational center of the hub and being in contact with a valley part of the cutout, the valley part being closer to the front edge part than any other parts of the cutout, the thickness-increased part extending from an inner circumference of the blade toward the outer circumference of the blade.

The fourth axial fan includes: a hub; and a plurality of blades arranged in a circumferential direction of the hub, wherein each of the plurality of blades has a cutout in a rear edge part of the blade, the rear edge part being opposite to a front edge part of the blade in a rotational direction of the blade, the cutout extending from the rear edge part toward the front edge part such that the cutout divides the rear edge part into an outer rear edge part and an inner rear edge part, wherein the blade has a blade surface having a thickness-increased part being located closer to the front edge part relative to a tangent line extending through a rotational center of the hub and being in contact with a valley part of the cutout, the valley part being closer to the front edge part than any other parts of the cutout, the thickness-increased part extending from an inner circumference of the blade toward an outer circumference of the blade, wherein a first thickness-reduced part and a second thickness-reduced part, in each of which the blade is thinned, are respectively disposed on both sides of the thickness-increased part such that the first thickness-reduced part is positioned closer to the front edge part and the second thickness-reduced part is positioned closer to the rear edge part.

The fifth axial fan is the fourth axial fan configured such that: a plurality of grooves is provided in a part of the inner rear edge part, the part being adjacent to the cutout, the plurality of grooves being arranged along the inner rear edge part, the plurality of grooves penetrating the blade in a thickness direction of the blade, the plurality of grooves extending toward the front edge part; and the second thickness-reduced part is formed to extend from the hub toward the outer circumference of the blade while retaining a predetermined distance from the inner rear edge part.

The sixth axial fan includes: a hub; and a plurality of blades arranged in a circumferential direction of the hub, wherein each of the plurality of blades has a cutout in a rear edge part of the blade, the rear edge part being opposite to a front edge part of the blade in a rotational direction of the blade, the cutout extending from the rear edge part toward the front edge part such that the cutout divides the rear edge part into an outer rear edge part and an inner rear edge part, wherein the inner rear edge part has a part which is adjacent to the cutout and in which a plurality of grooves is provided along the inner rear edge part, the plurality of grooves penetrating through the blade in a thickness direction of the blade, the plurality of grooves extending toward the front edge part, and wherein the blade surface of the blade has a thickness-reduced part, in which the blade is thinned, the thickness-reduced part extending from the hub toward an outer circumference of the blade while retaining a predetermined distance from the inner rear edge part.

The first outdoor unit includes: a compressor for compressing a refrigerant; a heat exchanger which is connected to the compressor and through which the refrigerant flows; and any of the first to sixth axial fans for sending air to the heat exchanger.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising:

a hub;

a plurality of blades arranged in a circumferential direction of the hub;

a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part;

a rib in a blade surface of the each of the plurality of blades, the rib extending from the hub toward an outer circumference of the each of the plurality of blades along the front edge part; and a first thickness-reduced part adjacent to an end of the rib, the end of the rib being closer to the outer circumference, the each of the plurality of blades being thinned in the first thickness-reduced part, wherein the first thickness-reduced part is provided away from the hub in a radial direction of the hub.

2. The axial fan according to claim 1, further comprising:

a plurality of grooves in a part of the inner rear edge part, the part of the inner rear edge part being adjacent to the cutout, the plurality of grooves being arranged along the inner rear edge part, penetrating through the each of the plurality of blades in a thickness direction of the each of the plurality of blades, and extending toward the front edge part; and a second thickness-reduced part in the blade surface of the each of the plurality of blades, the second thickness-reduced part being extending from the hub toward the outer circumference of the each of the plurality of blades while retaining a predetermined distance from the inner rear edge part, the each of the plurality of blades being thinned in the second thickness-reduced part.

3. The axial fan according to claim 2, further comprising:

a thickness-increased part adjacent to the second thickness-reduced part and interposed between the second thickness-reduced part and the inner rear edge part, wherein the thickness-increased part is smaller than the second thickness-reduced part on the blade surface.

4. An outdoor unit comprising:

a compressor which compresses a refrigerant;

a heat exchanger which is connected to the compressor and through which the refrigerant flows; and an axial fan according to claim 1 which sends air to the heat exchanger.

5. An axial fan comprising:

a hub;

a plurality of blades arranged in a circumferential direction of the hub;

a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part;

a first thickness-increased part in a blade surface of the each of the plurality of blades, the first thickness-increased part being closer to the front edge part than a tangent line is, the tangent line extending through a rotational center of the hub and being in contact with a valley part of the cutout, the valley part being closer to the front edge part than any other parts of the cutout, the first thickness-increased part extending from an inner circumference of the each of the plurality of blades toward an outer circumference of the each of the plurality of blades;

a first thickness-reduced part being adjacent to a part of the first thickness-increased part, the part being closer to the front edge part, the each of the plurality of blades being thinned in the first thickness-reduced part; and a second thickness-reduced part being adjacent to a part of the first thickness-increased part, the part being closer to the rear edge part, the each of the plurality of blades being thinned in the second thickness-reduced part, wherein the first thickness-reduced part is provided away from the hub in a radial direction of the hub, and the first thickness-increased part is provided between the first thickness-reduced part and the second thickness-reduced part.

6. The axial fan according to claim 5, further comprising:

a plurality of grooves in a part of the inner rear edge part, the part of the inner rear edge part being adjacent to the cutout, the plurality of grooves being arranged along the inner rear edge part, penetrating through the each of the plurality of blades in a thickness direction of the each of the plurality of blades, and extending toward the front edge part, wherein the second thickness-reduced part extends from the hub toward the outer circumference of the each of the plurality of blades while retaining a predetermined distance from the inner rear edge part, and spans, in the circumferential direction of the hub, across the tangent line.

7. The axial fan according to claim 6, further comprising:

a second thickness-increased part adjacent to the second thickness-reduced part and interposed between the second thickness-reduced part and the inner rear edge part, wherein the second thickness-increased part is smaller than the second thickness-reduced part on the blade surface.

8. An axial fan comprising:

a hub;

a plurality of blades arranged in a circumferential direction of the hub;

a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part;

a plurality of grooves in a part of the inner rear edge part, the part of the inner rear edge part being adjacent to the cutout, the plurality of grooves being arranged along the inner rear edge part, penetrating through the each of the plurality of blades in a thickness direction of the each of the plurality of blades, and extending toward the front edge part; and a thickness-reduced part in the blade surface of the each of the plurality of blades, the thickness-reduced part being extending from the hub toward an outer circumference of the each of the plurality of blades while retaining a predetermined distance from the inner rear edge part, the each of the plurality of blades being thinned in the thickness-reduced part, wherein the thickness-reduced part spans, in the circumferential direction of the hub, across a tangent line extending through a rotational center of the hub and being in contact with a valley part of the cutout being closer to the front edge part than any other part of the cutout.

9. The axial fan according to claim 8, further comprising:

a thickness-increased part adjacent to the thickness-reduced part and interposed between the thickness-reduced part and the inner rear edge part, wherein the thickness-reduced part is smaller than the thickness-increased part on the blade surface.

10. An axial fan comprising:

a hub;

a plurality of blades arranged in a circumferential direction of the hub;

a cutout in a rear edge part of each of the plurality of blades, the rear edge part being opposite to a front edge part of the each of the plurality of blades in a rotational direction of the each of the plurality of blades, the cutout extending from the rear edge part toward the front edge part such that the cutout divides the rear edge part into an outer rear edge part and an inner rear edge part;

a rib in a blade surface of the each of the plurality of blades, the rib extending from the hub toward an outer circumference of the each of the plurality of blades along the front edge part;

a first thickness-reduced part adjacent to an end of the rib, the end of the rib being closer to the outer circumference, the each of the plurality of blades being thinned in the first thickness-reduced part;

a plurality of grooves in a part of the inner rear edge part, the part of the inner rear edge part being adjacent to the cutout, the plurality of grooves being arranged along the inner rear edge part, penetrating through the each of the plurality of blades in a thickness direction of the each of the plurality of blades, and extending toward the front edge part;

a second thickness-reduced part in the blade surface of the each of the plurality of blades, the second thickness-reduced part being extending from the hub toward the outer circumference of the each of the plurality of blades while retaining a predetermined distance from the inner rear edge part, the each of the plurality of blades being thinned in the second thickness-reduced part; and a first thickness-increased part in the blade surface of the each of the plurality of blades, the first thickness-increased part being located between the first thickness-reduced part and the second thickness-reduced part such that the first thickness-increased part is closer to the front edge part than a tangent line is, the tangent line extending through a rotational center of the hub and being in contact with a valley part of the cutout, the valley part being closer to the front edge part than any other parts of the cutout, the first thickness-increased part extending from an inner circumference of the each of the plurality of blades toward the outer circumference of the each of the plurality of blades, wherein the first thickness-reduced part is provided away from the hub in a radial direction of the hub, and the first thickness-increased part is provided between the first thickness-reduced part and the second thickness-reduced part.

* * * * *